US012495945B2

(12) United States Patent
Mueggenborg et al.

(10) Patent No.: US 12,495,945 B2
(45) Date of Patent: *Dec. 16, 2025

(54) DISHWASHER SUMP AND DISHWASHER APPARATUS

(71) Applicant: Ecolab USA Inc., Saint Paul, MN (US)

(72) Inventors: Brock Mueggenborg, Saint Paul, MN (US); Jason Heintz, New Brighton, MN (US); Marvin Harris York, Minneapolis, MN (US); Nathan Evans, Apple Valley, MN (US)

(73) Assignee: Ecolab USA Inc., Saint Paul, MN (US)

( * ) Notice: Subject to any disclaimer, the term of this patent is extended or adjusted under 35 U.S.C. 154(b) by 69 days.

This patent is subject to a terminal disclaimer.

(21) Appl. No.: 18/500,362

(22) Filed: Nov. 2, 2023

(65) Prior Publication Data

US 2024/0057845 A1 Feb. 22, 2024

Related U.S. Application Data

(63) Continuation of application No. 16/892,136, filed on Jun. 3, 2020, now Pat. No. 11,903,545.
(Continued)

(51) Int. Cl.
*A47L 15/42* (2006.01)
*A47L 15/44* (2006.01)
*A47L 15/00* (2006.01)

(52) U.S. Cl.
CPC ..... *A47L 15/4225* (2013.01); *A47L 15/4221* (2013.01); *A47L 15/4223* (2013.01);
(Continued)

(58) Field of Classification Search
CPC ..... A47L 15/4221; A47L 15/4225; A47L 15/4293; A47L 15/4289; A47L 15/4297;
(Continued)

(56) References Cited

U.S. PATENT DOCUMENTS 2,692,605 A 10/1954 Jacques et al.
2,715,408 A 8/1955 Jacques et al.
(Continued)

FOREIGN PATENT DOCUMENTS

CN 1763491 4/2006
CN 101653349 2/2010
(Continued)

OTHER PUBLICATIONS

"International Application Serial No. PCT US2020 035979, Invitation to Pay Additional Fees mailed Jul. 27, 2020", 2 pgs.
(Continued)

*Primary Examiner* — Benjamin L Osterhout
(74) *Attorney, Agent, or Firm* — Schwegman Lundberg & Woessner, P.A.

(57) ABSTRACT

A dishwashing apparatus may include a sump. The sump may include a sump pan configured to couple with a wash chamber of the dishwashing apparatus. The sump may include a sump well coupled to the sump pan and configured to collect the liquid from the sump pan. The sump well may include a well inlet in communication with the sump pan. The sump pan may convey the liquid to the well inlet. A recirculation port extending through a first wall of the sump well. A drain port may extend through a second wall of the sump well. The second wall defines a bottom of the sump well. The dishwashing apparatus may include a controller. The controller may monitor electrical characteristics of a pump. The controller may provide a notification if fluid is not flowing through the pump.

20 Claims, 10 Drawing Sheets

Related U.S. Application Data

(60) Provisional application No. 62/856,572, filed on Jun. 3, 2019.

(52) U.S. Cl.
CPC ..... *A47L 15/4246* (2013.01); *A47L 15/4289* (2013.01); *A47L 15/4293* (2013.01); *A47L 15/4297* (2013.01); *A47L 15/44* (2013.01); *A47L 15/0055* (2013.01); *A47L 15/4272* (2013.01); *A47L 2401/02* (2013.01); *A47L 2401/023* (2013.01); *A47L 2401/06* (2013.01); *A47L 2401/14* (2013.01); *A47L 2401/30* (2013.01); *A47L 2501/26* (2013.01)

(58) Field of Classification Search
CPC .. A47L 15/44; A47L 15/4246; A47L 15/4223; A47L 2501/26; A47L 2401/06; A47L 2401/14; A47L 2401/30; A47L 15/0055; A47L 2401/02; A47L 2401/023; A47L 15/4272
See application file for complete search history.

(56) References Cited

U.S. PATENT DOCUMENTS

| | | | | |
|---|---|---|---|---|
| 3,051,182 | A | 8/1962 | Gibson | |
| 3,963,046 | A | 6/1976 | Bergeson | |
| 5,368,379 | A | 11/1994 | Wrangberth | |
| 8,857,450 | B2 | 10/2014 | Haltmayer et al. | |
| 9,119,520 | B2 | 9/2015 | Plum et al. | |
| 10,004,377 | B2 | 6/2018 | Haltmayer et al. | |
| 11,903,545 | B2 * | 2/2024 | Mueggenborg ..... | A47L 15/4297 |
| 2006/0005863 | A1 | 1/2006 | Gurubatham et al. | |
| 2006/0060228 | A1 | 3/2006 | Yoon et al. | |
| 2008/0141734 | A1 * | 6/2008 | Son ..... | D06F 58/50 68/5 C |
| 2009/0272003 | A1 * | 11/2009 | Dalton ..... | D06F 33/57 34/329 |
| 2010/0012159 | A1 | 1/2010 | Verma et al. | |
| 2012/0018448 | A1 | 1/2012 | Mehus et al. | |
| 2012/0186609 | A1 | 7/2012 | Haltmayer et al. | |
| 2014/0261576 | A1 | 9/2014 | Lee et al. | |
| 2016/0198929 | A1 | 7/2016 | Forster | |
| 2016/0367106 | A1 | 12/2016 | Thiyagarajan et al. | |
| 2020/0375430 | A1 | 12/2020 | Mueggenborg et al. | |

FOREIGN PATENT DOCUMENTS

| | | | | |
|---|---|---|---|---|
| CN | 103169438 | | 6/2013 | |
| CN | 104768441 | | 7/2015 | |
| CN | 104780821 | | 7/2015 | |
| CN | 108209787 | | 6/2018 | |
| CN | 113873930 | | 12/2021 | |
| DE | 102011000729 | A1 * | 10/2011 | ..... D06F 33/02 |
| EP | 1386575 | | 2/2004 | |
| EP | 3424398 | | 1/2019 | |
| GB | 1024139 | | 3/1966 | |
| JP | H04103857 | | 9/1992 | |
| JP | H05317228 | | 12/1993 | |
| JP | 2008307092 | | 12/2008 | |
| JP | 2022535825 | | 8/2022 | |
| JP | 2024147586 | | 10/2024 | |
| KR | 20170056379 | A * | 5/2017 | |
| TR | 201618937 | A * | 7/2017 | ..... A47L 15/0049 |
| WO | WO-2008125482 | A2 * | 10/2008 | ..... A47L 15/0049 |
| WO | 2016101993 | | 6/2016 | |
| WO | WO-2019052664 | A1 * | 3/2019 | ..... D06F 23/02 |
| WO | 2020247538 | | 12/2020 | |

OTHER PUBLICATIONS

"International Application Serial No. PCT US2020 035979, International Search Report mailed Oct. 6, 2020", 4 pgs.
"International Application Serial No. PCT US2020 035979, Written Opinion mailed Oct. 6, 2020", 7 pgs.
"International Application Serial No. PCT US2020 035979, International Preliminary Report on Patentability mailed Dec. 16, 2021", 9 pgs.
"U.S. Appl. No. 16/892,136, Restriction Requirement mailed May 26, 2022", 6 pgs.
"U.S. Appl. No. 16/892,136, Response filed Jul. 26, 2022 to Restriction Requirement mailed May 26, 2022", 8 pgs.
"U.S. Appl. No. 16/892,136, Non Final Office Action mailed Oct. 5, 2022", 9 pgs.
"Canadian Application Serial No. 3,141,520, Examiner's Rule 86(2) Report mailed Dec. 1, 2022.", 4 pgs.
"Japanese Application Serial No. 2021-571718, Notification of Reasons for Refusal mailed Feb. 7, 2023", (w English Translation), 11 pgs.
"U.S. Appl. No. 16/892,136, Response filed Mar. 6, 2023 to Non Final Office Action mailed Oct. 5, 2022", 13 pgs.
"Canadian Application Serial No. 3141520 Response filed Apr. 3, 2023 to Examiners Rule 86 2 Report mailed Dec. 1, 2022", 45 pages.
"European Application Serial No. 20819308.6, Communication pursuant to Rule 164(1) EPC mailed Jun. 9, 2023", 15 pgs.
"U.S. Appl. No. 16/892,136, Notice of Allowance mailed Jun. 22, 2023", 11 pgs.
"Japanese Application Serial No. 2021-571718, Response to Notification of Reasons for Refusal mailed Feb. 7, 2023", with English translation, 18 pgs.
"U.S. Appl. No. 16/892,136, Notice of Allowance mailed Sep. 8, 2023", 13 pgs.
"Canadian Application Serial No. 3,141,520, Office Action mailed Aug. 22, 2023.", 4 pgs.
"European Application Serial No. 20819308.6, Extended European Search Report mailed Sep. 21, 2023", 14 pgs.
"Chinese Application Serial No. 202080037418.3, Office Action mailed Oct. 13, 2023", w English Translation, 2 pgs.
"Japanese Application Serial No. 2021-571718, Office Action mailed Nov. 7, 2023", W English Translation, 28 pgs.
"Chinese Application Serial No. 202080037418.3, Response filed Dec. 8, 2023 to Office Action mailed Oct. 13, 2023", W English Claims, 44 pgs.
"U.S. Appl. No. 16/892,136, Notice of Allowance mailed Dec. 20, 2023", 13 pgs.
"Canadian Application Serial No. 3,141,520, Response Filed Dec. 13, 2023 to Office Action mailed Aug. 22, 2023.", 15 pgs.
"Chinese Application Serial No. 202080037418.3, Office Action mailed Jan. 30, 2024", w English Translation, 19 pgs.
"Japanese Application Serial No. 2021-571718, Decision of Rejection mailed Feb. 27, 2024", w English Translation, 4 pgs.
"Japanese Application Serial No. 2021-571718, Response Filed Jan. 22, 2024 to Office Action mailed Nov. 7, 2023", W English Claims, 11 pgs.
"Chinese Application Serial No. 202080037418.3, Response filed May 30, 2024 to Office Action mailed Jan. 30, 2024", W English Claims, 15 pgs.
"Japanese Application Serial No. 2021-571718, Response Filed Jun. 27, 2024 to Decision of Rejection mailed Feb. 27, 2024", w English Claims, 16 pgs.
"Japanese Application Serial No. 2021-571718, Pre-Trial Examination Notification mailed Jul. 9, 2024", w Machine English Translation, 3 pgs.
"European Application Serial No. 20819308.6, Response Filed Apr. 11, 2024 to Extended European Search Report mailed Sep. 21, 2023", 28 pgs.
"Japanese Application Serial No. 2024-104147, Voluntary Amendment Filed Jul. 25, 2024", w English Claims, 3 pgs.
"Canadian Application Serial No. 3,141,520, Examiners Rule 86(2) Report mailed Jul. 31, 2024", 5 pgs.
"Chinese Application Serial No. 202080037418.3, Office Action mailed Aug. 17, 2024", w English Translation, 15 pgs.
"Chinese Application Serial No. 202080037418.3, Response filed Sep. 25, 2024 to Office Action mailed Aug. 17, 2024", W English Claims, 16 pgs.

(56) References Cited

OTHER PUBLICATIONS

"Chinese Application Serial No. 202080037418.3, Decision of Rejection mailed Oct. 13, 2024", W English Translation, 12 pgs.
"Canadian Application Serial No. 3,141,520, Response Filed Dec. 2, 2024 Examiners Rule 86(2) Report mailed Jul. 31, 2024", 10 pgs.
"Chinese Application Serial No. 202080037418.3, Resposne Filed Jan. 9, 2025 ro Decision of Rejection mailed Oct. 13, 2024", w English Claims, 18 pgs.

* cited by examiner

DISHWASHER SUMP AND DISHWASHER APPARATUS

CLAIM OF PRIORITY

This patent application is a continuation of U.S. patent application Ser. No. 16/892,136, filed Jun. 3, 2020, which claims the benefit of priority of Mueggenborg et al. U.S. Provisional Patent Application Ser. No. 62/856,572, entitled "DISHWASHER SUMP AND DISHWASHER APPARATUS," filed on Jun. 3, 2019, each of which are hereby incorporated by reference herein in their entirety.

BACKGROUND

A dishwasher may clean items (e.g., dishes, utensils, or the like). The dishwasher may include a wash chamber, and the items may be located in the wash chamber. The dishwasher may spray a liquid within the wash chamber to clean the items. The liquid may flow within the wash chamber and the liquid may be received by a sump.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventors have recognized, among other things, that a problem to be solved may include reducing the amount of liquid (e.g., water) that is used during operation of a dishwasher. Such problems may be solved by reducing cavitation of a pump that cycles the liquid through the dishwasher. A sump for a dishwashing apparatus may provide a solution to these problems. For example, the sump may help provide a flow of liquid to a pump to help prevent cavitation. The sump may include a sump pan having a pan inlet. The sump pan may be configured to couple with a wash chamber of the dishwashing apparatus. The pan inlet may be configured to receive a liquid from the wash chamber. A sump well may be coupled to the sump pan, and the sump well may be configured to collect the liquid from the sump pan. The sump well may include a well inlet in communication with the sump pan. The sump pan may convey the liquid to the well inlet. The sump well may include a recirculation port extending through a first wall of the sump well. The recirculation port may be configured to provide the liquid to a recirculation pump. The sump pan and the sump well may be a unitary piece of material.

Figure 1:
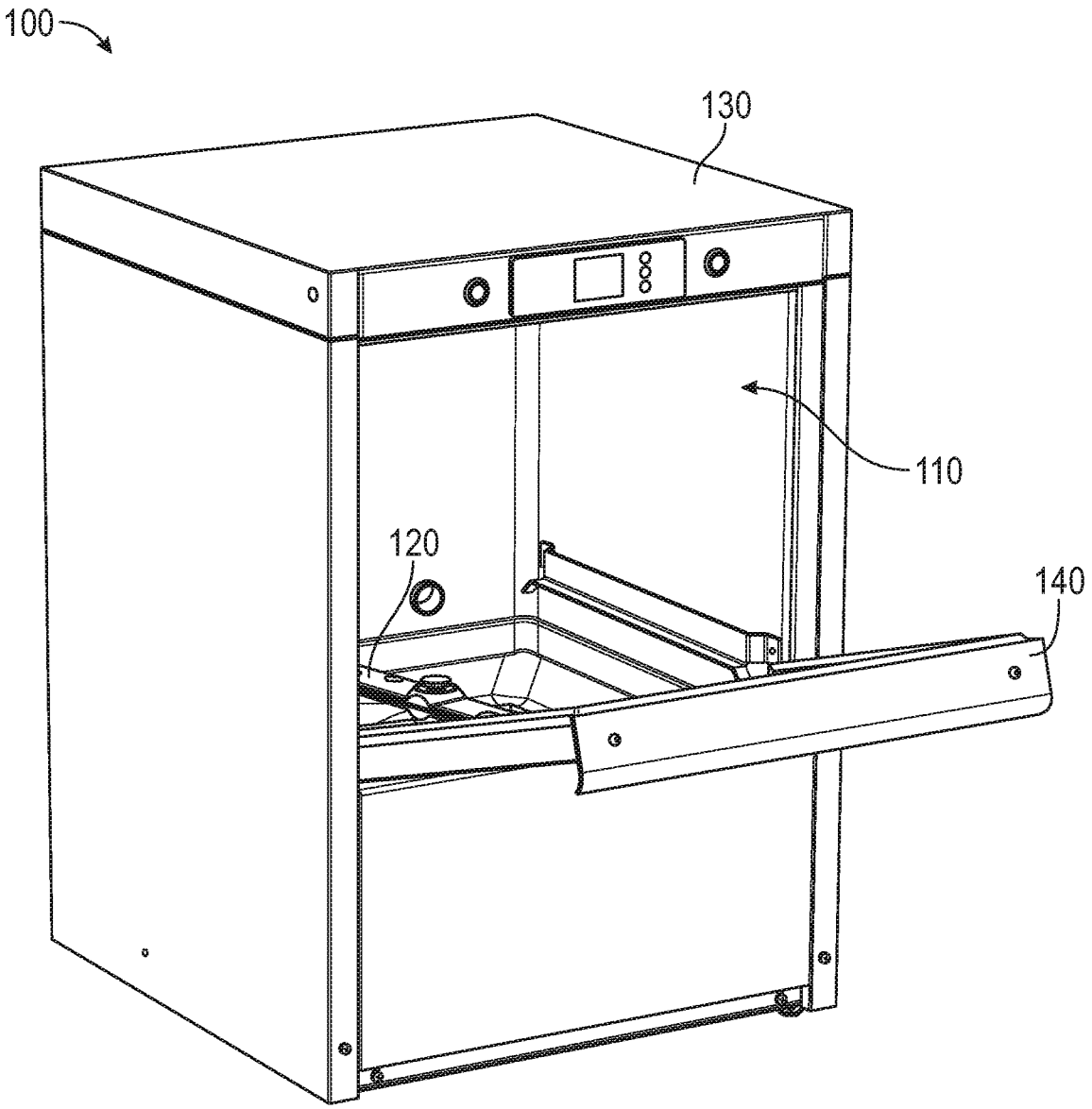
FIG. 1 illustrates an isometric view of an example of a dishwashing apparatus according to one embodiment of the present subject matter.

FIG. 1 illustrates an isometric view of an example of a dishwashing apparatus 100 according to one embodiment of the present subject matter. In some examples, the dishwashing apparatus 100 is sized and shaped for installation underneath a countertop. In another example, the dishwashing apparatus 100 is sized and shaped for countertop use. The dishwashing apparatus 100 may include a wash chamber 110 (e.g., a tub, chamber, vessel, or the like). Items located in the wash chamber 110 may be cleaned (e.g., washed, scrubbed, sanitized, disinfected, or the like) during operation of the dishwashing apparatus 100. For instance, dishes (e.g., glasses, cups, silverware, plates, or the like), medical instruments, or the like may be cleaned by the dishwashing apparatus 100.

A wash arm 120 may be located in the wash chamber 110, and the wash arm 120 may spray a liquid (e.g., water, a solution of water and soap, a solution of water and a cleanser, or the like). The wash arm 120 may rotate within the wash chamber 110 to clean items located in the wash chamber 110.

The wash chamber 110 may be at least partially defined by a body 130 (e.g., frame, support structure, or the like) of the dishwashing apparatus 100. A door 140 may be moveably coupled to the body 130, and the door 140 may provide access to the wash chamber 110. The door 140 may help prevent liquid from escaping the wash chamber 110 during operation of the dishwashing apparatus 100.

Figure 2:
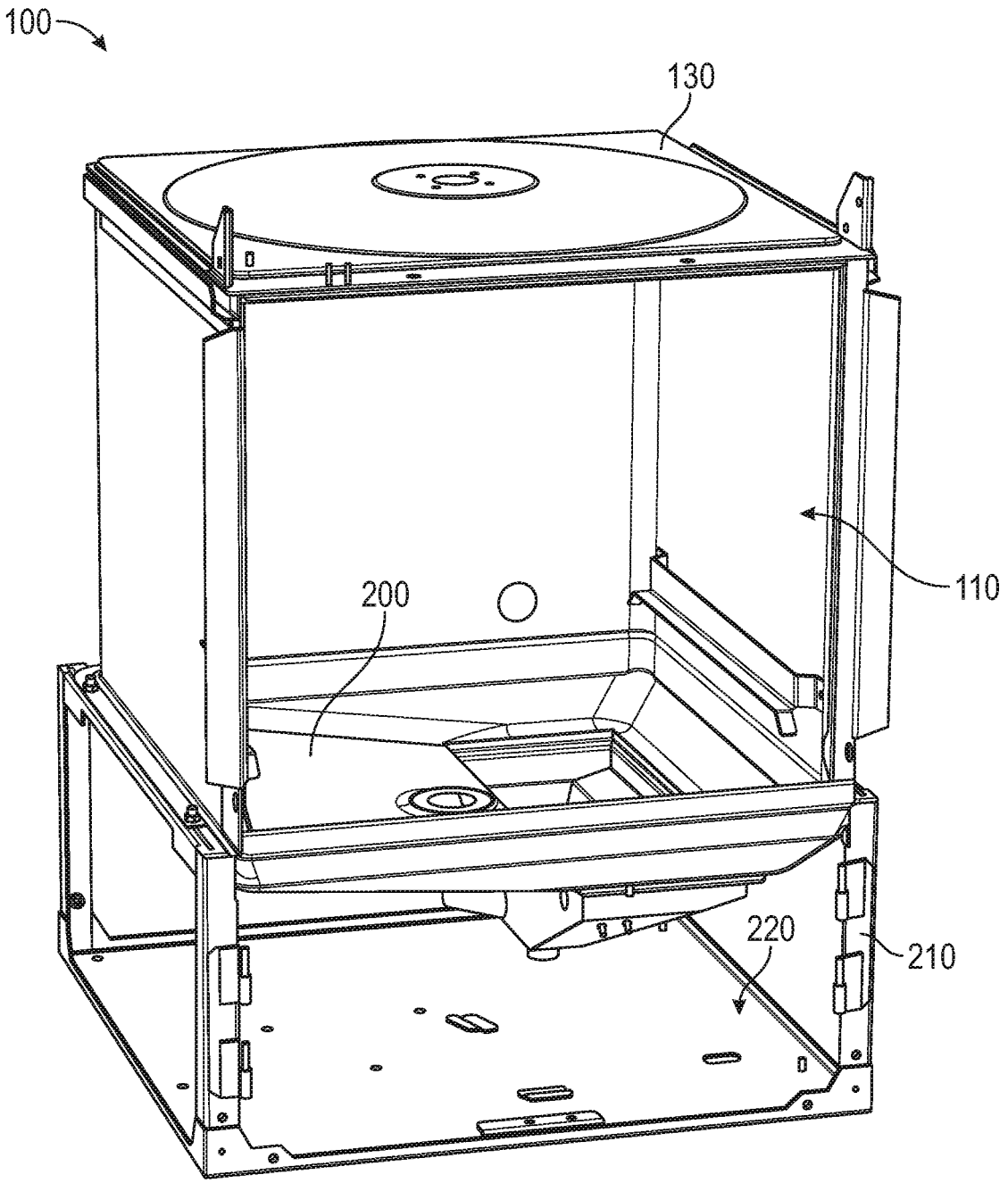
FIG. 2 illustrates another isometric view of an example of the dishwashing apparatus according to one embodiment of the present subject matter.

FIG. 2 illustrates another isometric view of an example of the dishwashing apparatus 100 according to one embodiment of the present subject matter. Portions of the dishwashing apparatus 100 (e.g., the door 140) have been hidden in FIG. 2 for clarity.

The dishwashing apparatus 100 may include a sump 200. The sump 200 may receive liquid that flows within the wash chamber 110 during operation of the dishwashing apparatus 100. For example, the sump 200 may be coupled to the body 130 of the dishwashing apparatus 100. The sump 200 may define a bottom of the wash chamber 110, and liquid within the wash chamber 110 may drain into the sump 200.

The dishwashing apparatus 100 may include a base 210, and the body 130 may be coupled to the base 210. The base 210 may define a service compartment 220 of the dishwashing apparatus 100. As described in greater detail herein, the service compartment 220 may house one or more components of the dishwashing apparatus 100. The sump 200 may be located between the wash chamber 110 and the service compartment 220. For instance, the sump 200 may separate the service compartment from the wash chamber 110.

Figure 3:
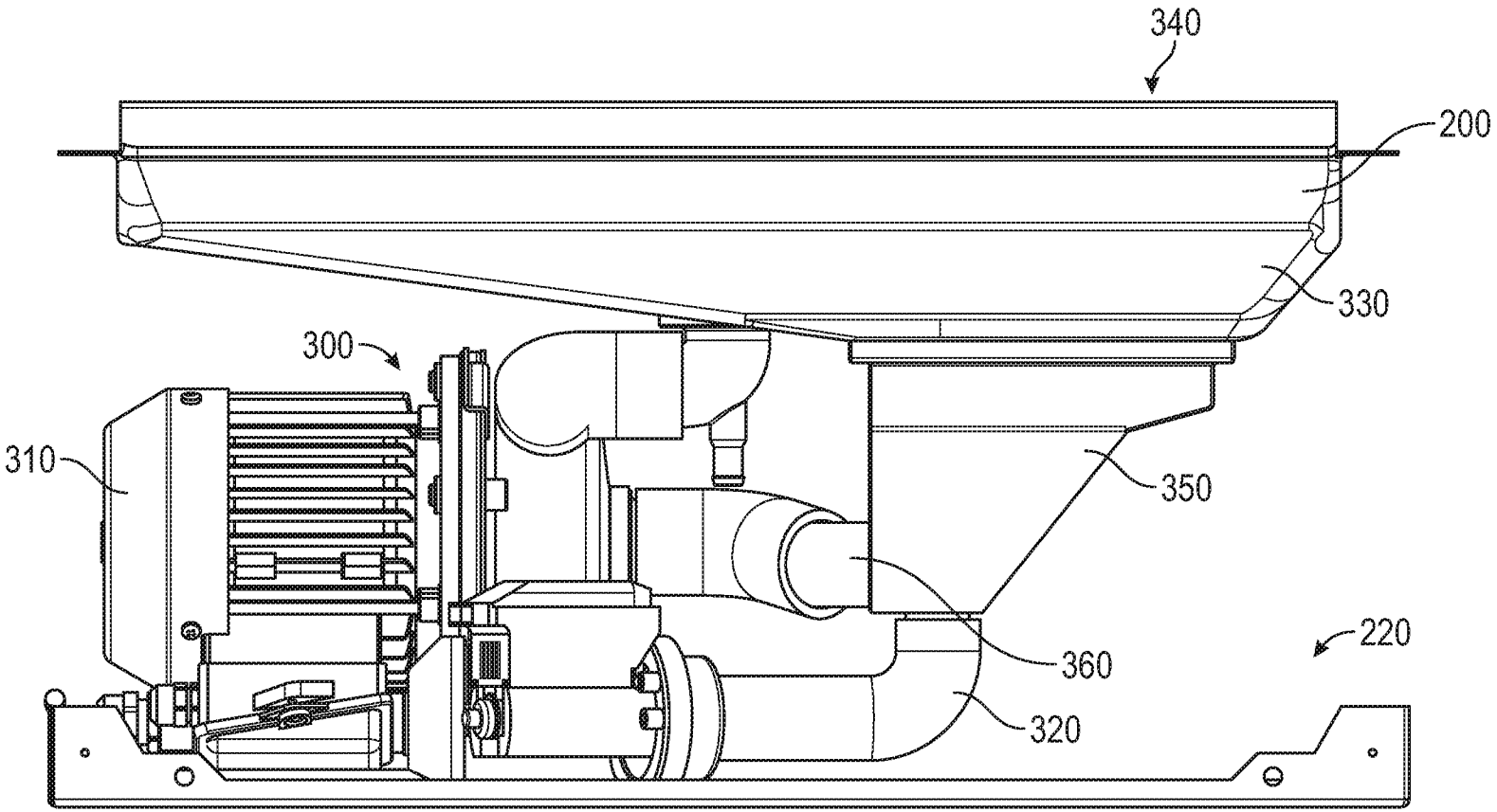
FIG. 3 illustrates a side view of an example of a sump and a pump system according to one embodiment of the present subject matter.

FIG. 3 illustrates a side view of an example of the sump 200 and a pump system 300 according to one embodiment of the present subject matter. The sump 200 may extend at least partially into the service compartment 220. The pump system 300 may include a pump 310, and the pump 310 may recirculate liquid within the dishwashing apparatus 100. For example, one or more hoses 320 may interconnect the sump 200 with the pump system 300, and the sump 200 may provide liquid to the pump 310. The pump system 300 may help facilitate draining liquid from the dishwashing apparatus 100. The pump system 300 may help facilitate recirculation of liquid within the dishwashing apparatus 100. In an example, the pump system 300 may supply liquid to the wash arms 120, for instance to facilitate spraying the liquid with the wash arms 120.

The sump 200 may include a sump pan 330, and the sump pan 330 may include a pan inlet 340. The pan inlet 340 may receive liquid from the wash chamber 110. For example, liquid may be sprayed by the wash arm 120 (e.g., as shown in FIG. 1) and the liquid may flow within the wash chamber 110 to the pan inlet 340 and the liquid may be received by (e.g., drain into, drip into, flow into, or the like) the sump pan 330.

The sump 200 may include a sump well 350. The sump well 350 may be coupled to the sump pan 330, and the sump well 350 may receive liquid from the sump pan 330. In an example, the sump well 350 may collect liquid from the sump pan 330 (and the wash chamber 11). For instance, the liquid received by the sump pan 330 may flow into the sump well 350, and the sump well 350 may collect the liquid.

As described herein, the sump 200 may provide liquid to the pump 310. For instance, a recirculation flange 360 may be coupled to the sump 200, for instance the flange 360 may be coupled to the sump well 350. In an example, the flange 360 may be coupled to the sump well 350 at an angle (e.g., with respect to a wall of the sump well 350.

The recirculation flange 360 may facilitate coupling the sump 200 with the hoses 320. The liquid collected by the sump well 350 may flow from the sump well 350, flow through the recirculation flange 360 and the hoses 320, and may flow into pump 310. The sump 200 may help reduce the occurrence of cavitation within the pump 310. For instance, the sump pan 330 and the sump well 250 may cooperate to reduce the occurrence of cavitation within the pump 310, for example by providing a consistent flow of liquid to the pump 310.

Figure 4:
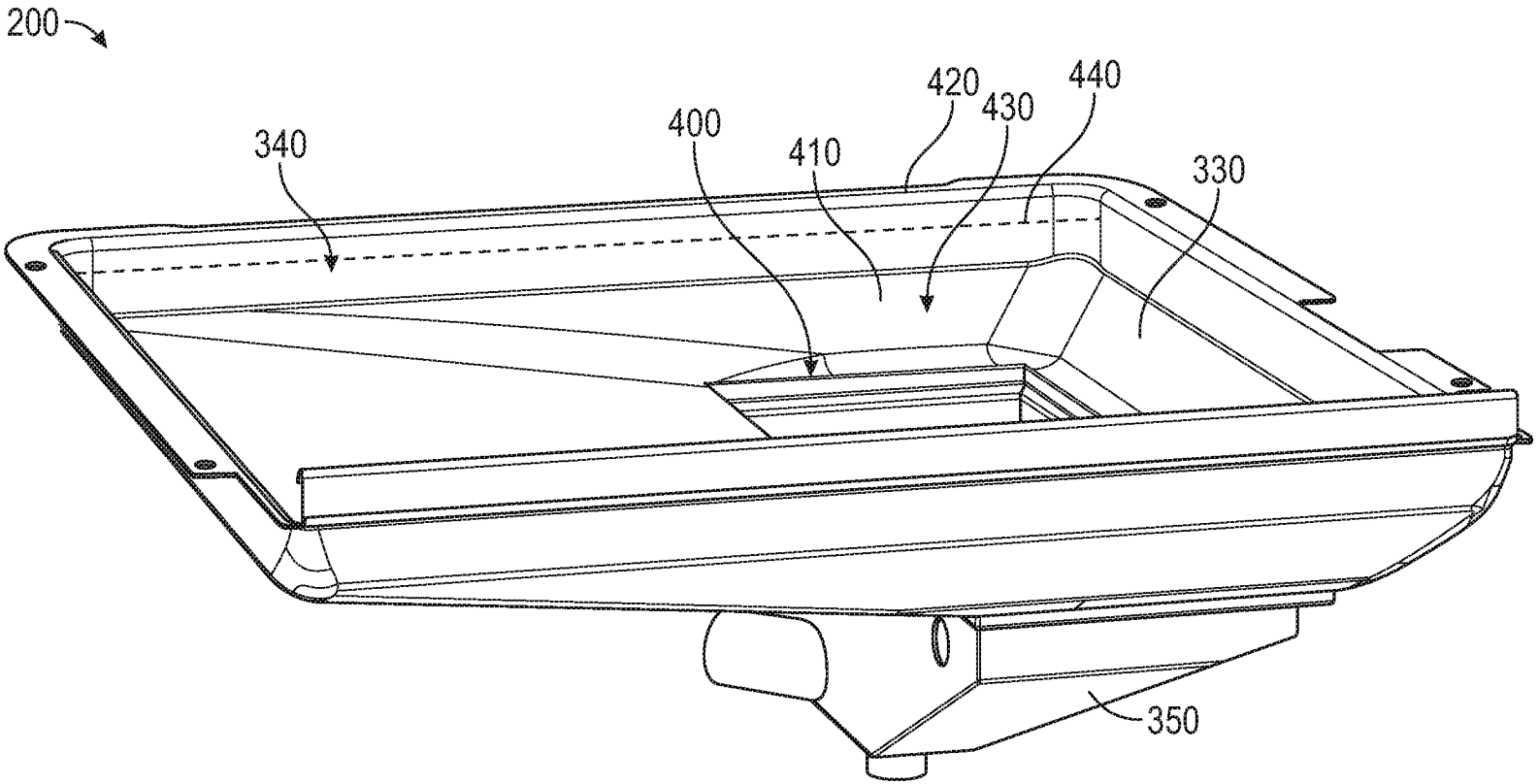
FIG. 4 illustrates a perspective view of an example of the sump of FIG. 3 according to one embodiment of the present subject matter.

FIG. 4 illustrates a perspective view of an example of the sump 200 of FIG. 3 according to one embodiment of the present subject matter. The sump 200 may include a well inlet 400. The well inlet 400 may be in communication with the sump pan 330, and the sump pan 330 may convey liquid to the well inlet 400 across the well inlet 400. For example, the sump pan 330 may include an inclined wall 410, and the inclined wall 410 may facilitate drainage of liquid into the sump well 350 (e.g., across the well inlet 400). The inclined wall 410 may facilitate collection of liquid in the sump pan 330 and into the sump well 350.

The sump 200 may include a lip 420, and the lip 420 may facilitate coupling the sump 200 with other components of the dishwashing apparatus 100, for example the sump 200 may be coupled to the body 130 or the wash chamber 110 (e.g., as shown in FIG. 1). The sump 200 may be coupled to the body 130 (or the wash chamber 110) with a welding operation, with fasteners, or the like.

The sump 200 may include a liquid containment portion 430, and the liquid containment portion 430 may correspond to a maximum level 440 of liquid within the sump 200. In an example, the sump 200 may be sized and shaped to have a volume that is greater than a volume of liquid that is introduced into the dishwashing apparatus 100. For instance, 1.5 gallons of liquid may be introduced into the dishwashing apparatus 100, and the sump may be sized and shaped to contain 2 gallons of liquid. Accordingly, the level of liquid in the sump 200 may not exceed the maximum level 440.

The maximum level 440 of liquid may be located below the lip 420 (e.g., the maximum level 440 may be remote from the lip 420. Because the lip 420 may be coupled to the body 130 (or the wash chamber 110), a seam (e.g., weld bead, gasket line, or the like) may be located at the interface of the lip 420 and the body 130 (or the wash chamber 110). Accordingly, locating the maximum level 440 of liquid below the lip 420 may help prevent leakage of the dishwashing apparatus 100. For example, the seam may leak due to corrosion (e.g., corrosion of a weld bead) or damage to a gasket. Locating the maximum level 440 of liquid below the lip 420 may help reduce the exposure of the seam to the liquid, and accordingly may reduce help the occurrence of leakage.

Figure 5:
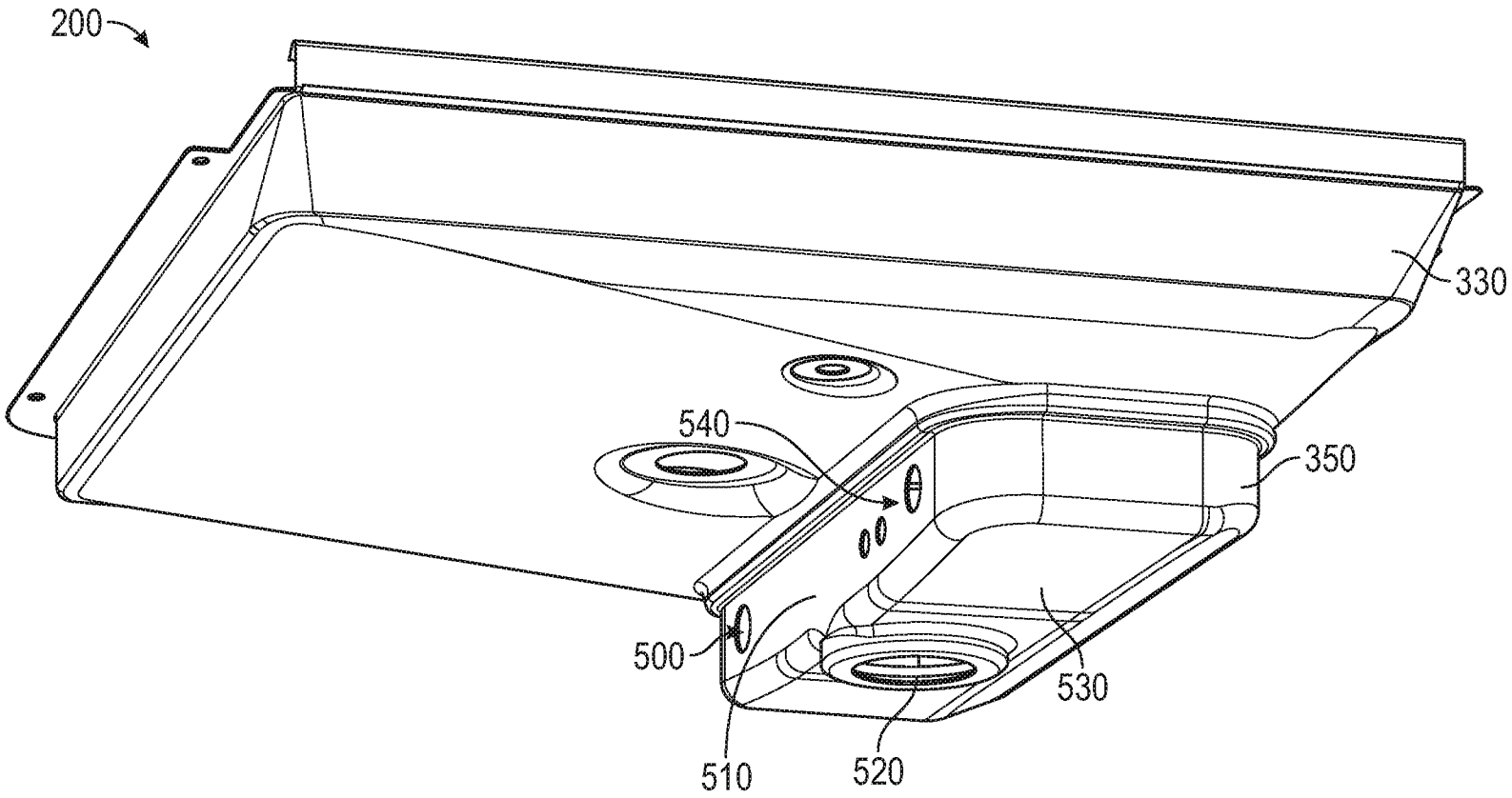
FIG. 5 illustrates another perspective view of an example of the sump of FIG. 3 according to one embodiment of the present subject matter.

FIG. 5 illustrates another perspective view of an example of the sump 200 of FIG. 3 according to one embodiment of the present subject matter. The sump 200 may include a recirculation port 500. The recirculation port 500 may extend through the sump well 350, for instance extending through a first wall 510 of the sump well 350. The recirculation port 500 may help provide liquid to the pump system 300, for example the pump 310. The recirculation flange 360 (e.g., as shown in FIG. 3) may be coupled to the sump well 550, and the recirculation flange 360 may be in communication with the recirculation port 500. Liquid may flow from the recirculation port 500 of the sump well 500 and into the recirculation flange 360.

The sump 200 may include a drain port 520, and the drain port 520 may help facilitate draining liquid from the sump 200 (and the dishwashing apparatus 100, for example as shown in FIG. 1). In an example, the sump well 530 may include a second wall 530 of the sump well 350. The second wall 530 may define a bottom of the sump well 350 (and the sump 200). The drain port 520 may extend through the second wall 530 of the sump well 350.

The recirculation flange 360 may be coupled to the wall 510, and coupling the recirculation flange 360 to the first wall 510 may help prevent leakage from the sump 200, for instance by reducing the exposure of a seam between the flange 360 and the port 500 to liquid. The first wall 510 may extend at an angle from the second wall 530 (e.g., the first wall 510 may be perpendicular to the second wall 530, or the first wall 510 may extend at a 20 degree angle from the second wall 530). Accordingly, liquid drains from the first wall 510 to the second wall 530 of the sump well 350 (e.g., because the second wall 530 defines a bottom of the sump well 350). Thus, exposure of the seam between the recirculation port 500 and the recirculation flange 360 (shown in FIG. 3) to liquid is reduced (e.g., because water drains away from the seam). Reducing the exposure of a seal to liquid may reduce leakage past the seal, for instance dripping from the sump well 350 into the service compartment 220 (shown in FIG. 2). In some examples, an inner diameter of the recirculation flange 360 may be greater than, or equal to, a diameter of the recirculation port 500. Accordingly, the seal between the recirculation flange 360 and the recirculation port 500 may be enhanced.

As described herein, the recirculation port 500 may extend through the first wall 510. The recirculation port 500 may be located proximate to the second wall 530, In an example, locating the recirculation port 500 proximate the second wall 530 enhances pumping of liquid from the sump well 350. For instance, liquid in the sump well 350 drains to the second wall 530 and locating the recirculation port 500 proximate the second wall 530 enhance pumping liquid from the sump well 350.

The recirculation port 500 may be located remote from the drain port 520. For example, the recirculation port 500 may extend through the first wall 510, and the drain port 520 may extend through the second wall 530. Locating the recirculation port 500 remote from the drain port 520 may improve the performance of the dishwashing apparatus 100, for example by inhibiting the flow of liquid into the sump well 350 from the drain port 520. In some approaches, the recirculation port 500 may be proximate to the drain port 520. Liquid may be pumped from the sump well 350 (e.g., with the pump system 300 to recirculate within the apparatus 100). The pumping of liquid from the sump well 350 may draw liquid from the drain port 520 into the sump well 350, for example because the drain port 520 and the recirculation port 500 are in fluidic communication when located proximate each other. For instance, a pressure differential generated at the recirculation port 500 (e.g., with the pump 310, shown in FIG. 3) generates a corresponding pressure differential at the drain port 520. Locating the recirculation port 500 remote from drain port 520 reduces fluidic communication between the ports 500, 520. Accordingly, performance of the dishwashing apparatus 100 is enhanced because the pump system 300 may not draw liquid from the drain port 520 (or a drain connected to the drain port 520).

The sump 200 may be a unitary piece of material. For example, the sump pan 330 and the sump well 350 may be a unitary piece of material. The sump 200 may be manufactured with a drawing operation (e.g., a deep draw operation, or the like), for instance by drawing a sheet of metal to define the sump pan 330 and the sump well 350 (e.g., by applying a force to the sheet of metal with die). A person having ordinary skill in the art may detect the drawing to define the sump pan 330. For instance, a grain structure of the metal of the sump pan 330 may indicate that the sump pan 330 was exposed to one or more drawing operations.

Providing the sump pan 330 and the sump well 350 as a unitary piece of material helps prevent leakage of the sump 200, and may help improve the performance of the dishwashing apparatus 100. In various examples, the design of the deep draw sump well 350 is sufficient that no manifold is necessary, thereby, avoiding additional locations of potential corrosion and future leaks, including, but not limited to, potential gasket leakage points (e.g., at a seam). In some approaches, the sump 200 includes more than one component. For example, a manifold may be coupled to the sump 200 (e.g., the sump pan 330). For instance, the manifold may be coupled to the sump 200 with a gasket and fasteners. The manifold may include ports that allow fluid to flow from the manifold. A seam between the sump 200 and the manifold may leak due to exposure to liquid, and the liquid may leak through the seam. Accordingly, providing the sump 200 with the sump pan 330 and the sump well 350 as a unitary piece of material eliminates seams, and may help reduce leakage from the sump 200, for instance because the recirculation port or the drain port 520 may not be included in a separate component from other portions of the sump 200.

The sump 200 may include at least one component through hole 540. The component through hole 540 may be configured to receive a heating element, or a thermostat. The heating element may heat liquid within the sump 200 (or the dishwashing apparatus 100). The thermostat may provide a signal indicative of the temperature of liquid in the sump 200 (or the dishwashing apparatus 100), The component through hole 640 may extend through the first wall 510 of the sump well 350, however the present subject matter is not so limited.

Figure 6:
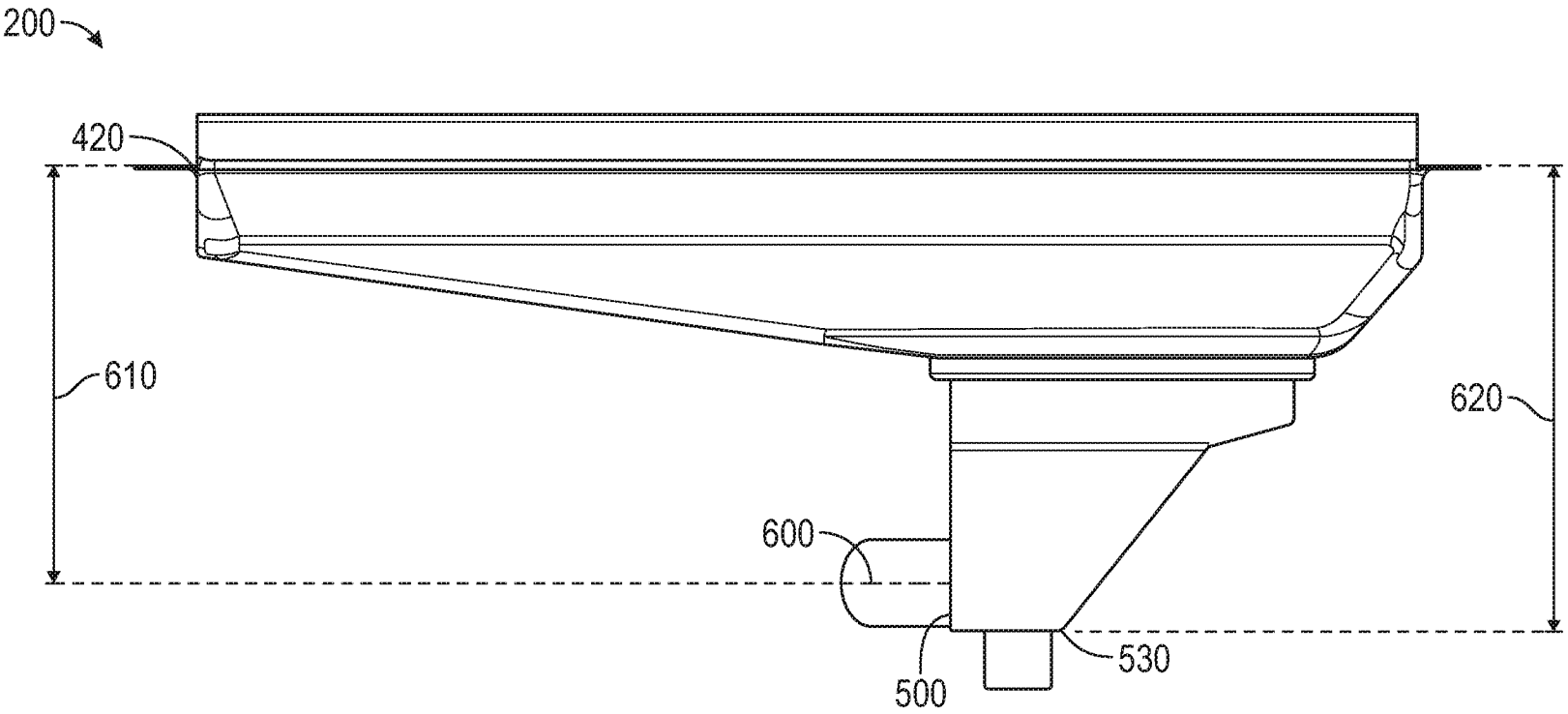
FIG. 6 illustrates a side view of an example of the sump of FIG. 3 according to one embodiment of the present subject matter.

FIG. 6 illustrates a side view of an example of the sump 200 of FIG. 3 according to one embodiment of the present subject matter. The recirculation port 500 may include a central axis 600. The central axis 600 may be located at the center of the recirculation port 500 (e.g., the central axis 600 may an axis that is aligned with the center of the recirculation port 500). The central axis 600 may be spaced apart from the lip 420 by a first distance 610. The first distance 610 may be 5.5 inches or more (e.g., 6.5 inches to 7 inches, 7 inches to 7.25 inches, 7.25 inches to 7.35 inches, or the like), however the present subject matter is not so limited. The second wall 530 may be spaced apart from the lip 420 by a second distance 620, The second distance 620 may be 5.5 inches or more (e.g., 6 inches, 6.5 inches to 7.5 inches, 8 inches to 8.25 inches, or the like), however the present subject matter is not so limited.

As described herein, the sump 200 may be a unitary piece of material, and the sump 200 may be manufactured using a drawing operation. The drawing operation may help facilitate manufacturing the sump 200 as a unitary piece of material with the first distance being greater than 6 inches. The drawing operation may help facilitate manufacturing the sump 200 as a unitary piece of material with the first distance 610 being greater than 5.5 inches. The drawing operation may help facilitate manufacturing the sump 200 as a unitary piece of material with the second distance 620 being greater than 5.5 inches.

Figure 7:
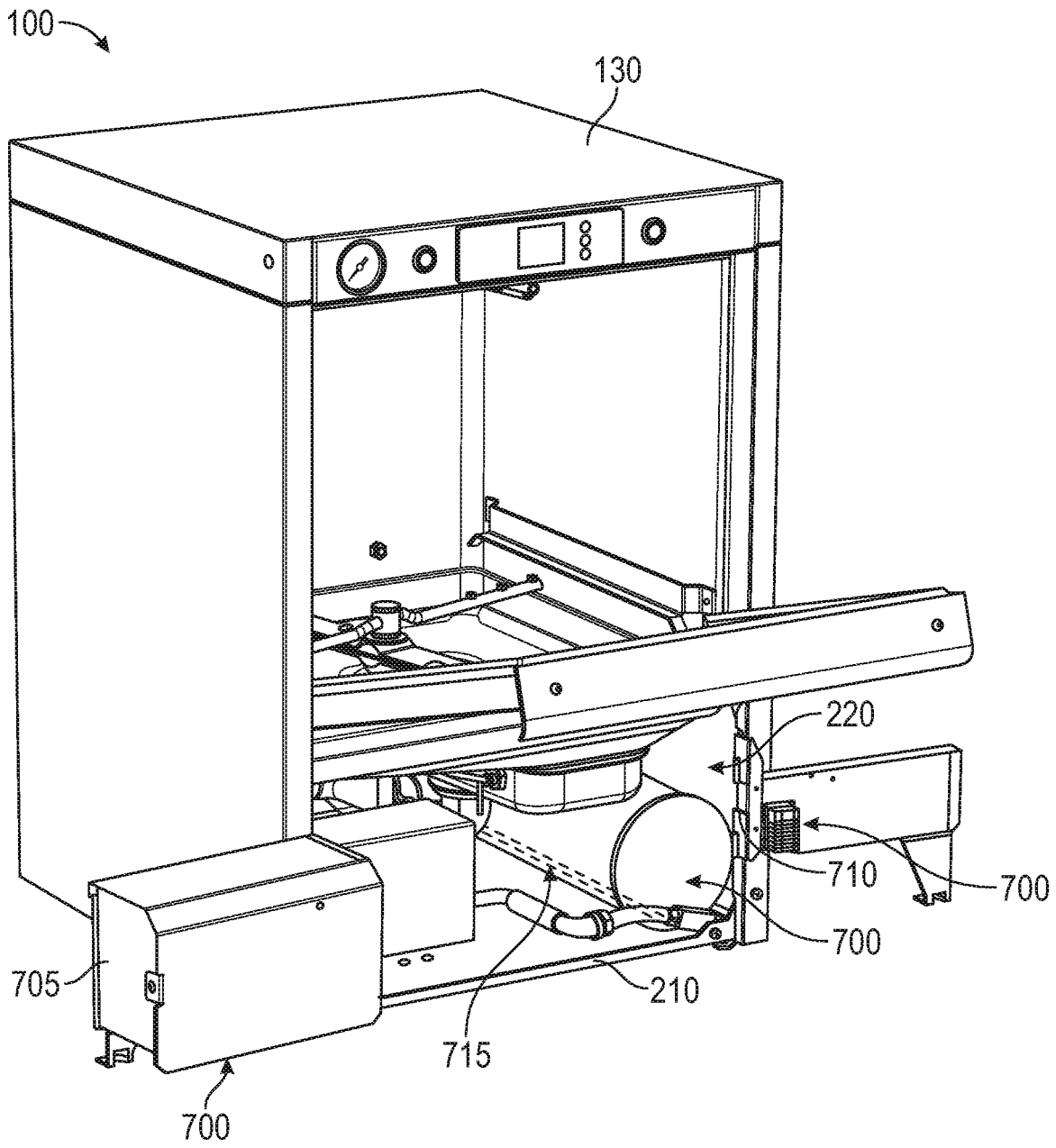
FIG. 7 illustrates another perspective view of an example of the dishwashing apparatus of FIG. 1 according to one embodiment of the present subject matter.

FIG. 7 illustrates another perspective view of an example of the dishwashing apparatus 100 of FIG. 1 according to one embodiment of the present subject matter. As described herein, the body 130 may be coupled to the base 210, and the wash chamber 110 may be defined by the body 130. The base 210 may define the service compartment 220. The service compartment 220 may house one or more components 700 of the dishwashing apparatus 100, for example the pump system 300 (shown in FIG. 3). The components 700 may include a pump, a reservoir 705 (e.g., cleaning product reservoir), hoses, heaters, transformers, or the like. The components 700 may be moveably coupled to the dishwashing apparatus 100, for instance to the base 210. A hinge 710 may facilitate movement of the components 700 and increase access to other components 700 within the service compartment 220, thereby simplifying service of the dishwashing apparatus 100 (e.g., repairs by a technician, or the like). The dishwashing apparatus 100 may include one or more rails 715 (shown in dashed lines in FIG. 7), and the components 700 may slide on the rails to move the components, for instance to move the components to provide access to the pump system 300 (e.g., as shown in FIG. 3).

Figure 8:
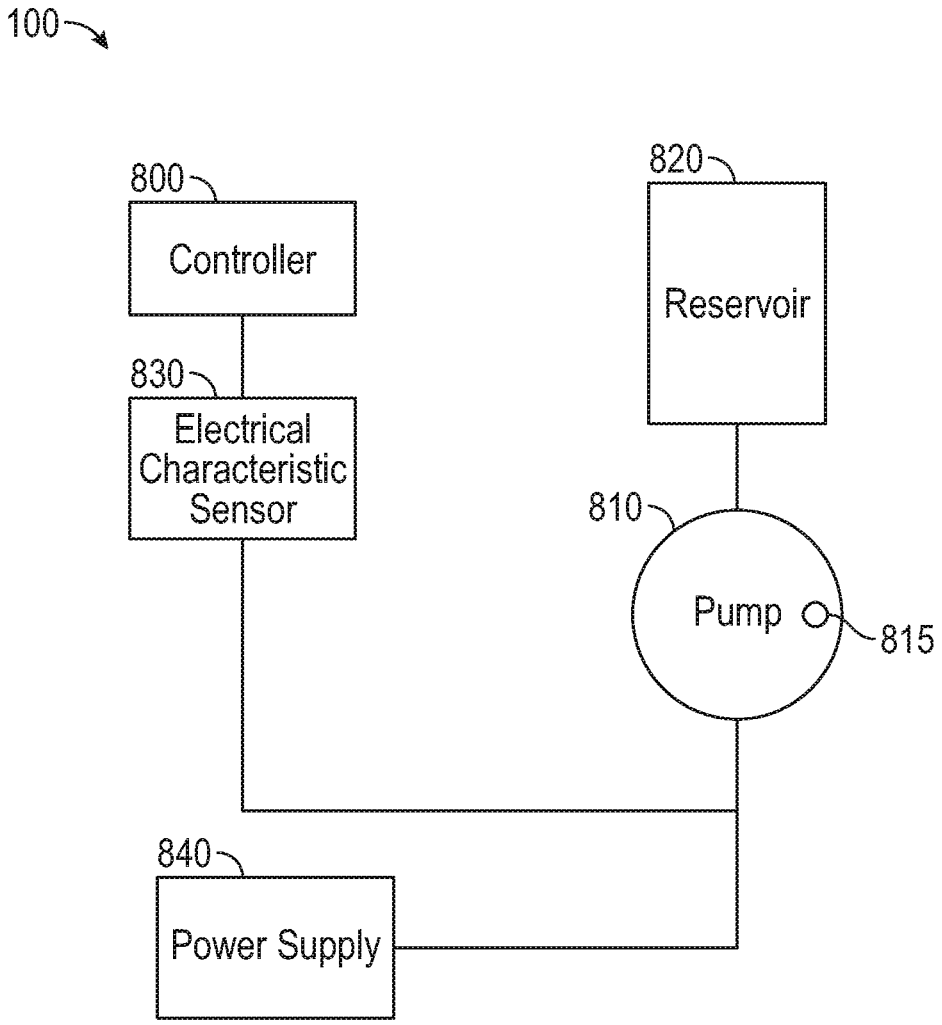
FIG. 8 illustrates a schematic diagram of an example of the dishwashing apparatus of FIG. 1 according to one embodiment of the present subject matter.

FIG. 8 illustrates a schematic diagram of an example of the dishwashing apparatus 100 of FIG. 1 according to one embodiment of the present subject matter. The dishwashing apparatus 100 may include a controller 800, and the controller 800 may include processing circuitry, for instance a processor. The controller 800 may control one or more functions of the dishwashing apparatus 100.

For example, the controller 800 may be in communication with a pump 810, for instance a diaphragm pump. The pump 810 may supply a cleaning product (e.g., detergent, solvent, bleach, soap, or the like) to the wash chamber 110 (e.g., as shown in FIG. 1) when the pump 810 is operated. For instance, the pump 810 may draw a cleaning product from a reservoir 820 (e.g., a container, jug, chamber, vessel, or the like). The pump 810 may supply the cleaning product, for instance at a discharge port 815, The cleaning product may include a liquid, a gas, or a combination thereof.

One or more electrical properties may vary in correspondence to whether the pump 810 is pumping a fluid (or the fluid being pumped). For example, the electrical current drawn by the pump 810 may increase when the pump 810 is pumping a liquid. The electrical current drawn by the pump 810 may decrease when the pump 810 is not pumping a liquid. For example, the current drawn by the pump 810 may decrease when the pump 810 is pumping a gas (in comparison to the current drawn by the pump 810 when the pump 810 is pumping a liquid). The current drawn by the pump 810 may increase when the pump 810 is not pumping a fluid (e.g., a fluid path between the reservoir 820 and the pump 810 is occluded). Accordingly, the controller 800 may monitor electrical characteristics of the pump 810, for instance to determine whether the pump 810 is pumping a fluid (or the fluid being pumped).

The controller 800 may monitor the one or more electrical properties of the pump 810. For instance, the controller 800 may be in communication with an electrical characteristic sensor 830, and the electrical characteristic sensor facilitates monitoring of one or more electrical characteristics of the pump 810. In an example, a power supply 840 provided power to the pump 810. The sensor 830 may measure one or more of current drawn by the pump 810 or voltage supplied to the pump 810. The controller 800 may be in communication with the sensor 830, and the controller 800 may monitor (e.g., record, analyze, interpret, or the like) the measurements provided by the sensor 830.

In an example, the electrical characteristic sensor 830 includes a resistor (e.g., a shunt resistor, or the like). The resistor 800 may be located in electrical communication with the pump (e.g., located in line with the power supply 840), The controller 800 may monitor a voltage potential across the resistor. The controller 800 may determine voltage draw by the pump 810, for example based on the monitored voltage potential across the resistor. The controller 800 (or the sensor 830) may include an amplifier, signal processing circuitry, or the like to facilitate monitoring of the electrical characteristics of the pump 810 with the controller 800.

The controller 800 may determine whether a fluid is flowing through the pump 810 during operation of the pump 810. In an example, the controller 800 determines a fluid flow metric for the pump 810. The fluid flow metric may be indicative of fluid flow through the pump 810. The controller 800 may determine the fluid flow metric based on the monitored electrical characteristics of the pump 810. The controller 800 may update the fluid flow metric based on a comparison of the electrical characteristics of the pump 810 to a characteristic threshold. For instance, the fluid flow metric may have a first value when the pump 810 is pumping a gas. The fluid flow metric may have a second value when the pump 810 is pumping a liquid. The fluid flow metric may have a third value when the pump 810 is not pumping a fluid.

In an example, the controller 800 may compare the electrical characteristics of the pump 810 to a characteristic threshold (e.g., a maximum, minimum, limit, rate of change, or the like). Determining whether the pump 810 is pumping a fluid may facilitate determining whether the reservoir 820 is depleted (e.g., low, drained, empty, out, or the like). Determining whether the pump 810 is pumping a fluid may facilitate determining whether the pump 810 is occluded (or whether there is an occlusion in a fluid line for the pump 810).

In an example, the controller 800 compares current drawn by the pump 810 to a current threshold. The controller 800 may determine that the pump 810 is pumping a gas when the current being drawn by the pump 810 exceeds a current threshold. For example, the pump 810 may operate at a first amperage (e.g., for a first time period) when the pump 810 is pumping a liquid. The pump 810 may operate at a second amperage (e.g., for a second time period) when the pump 810 is pumping a gas. The controller 800 may monitor the electrical characteristics of the pump 810, for example to determine the pump 810 is pumping liquid (e.g., cleaning product from the reservoir 820). The controller 800 monitors the electrical characteristics for a change, and compares the electrical characteristic (e.g., current, voltage, or the like) to the characteristic threshold (e.g., current threshold, voltage threshold, or the like). Accordingly, the controller 108 may determine when the pump 810 is pumping a liquid, pumping a gas, or if the pump 810 is occluded (e.g., if a line between the pump 810 and the reservoir 820 is clogged). The controller 800 may monitor cycles of the pump 810, for example when the pump 810 is modulated and liquid is pumped by the pump 810. As described in greater detail herein, the controller 800 may provide a notification, for instance when the controller 108 determines that a reservoir is depleted based on the cycles of the pump 810.

The controller 800 may provide a notification (e.g., by activating an indicator, such as a light, a noise, or the like) that fluid is not flowing through the pump 810. For example, the pump 810 may draw a cleaning product from the reservoir 820. The cleaning product may be depleted from reservoir 820 when the pump 810 is operated. As described herein, when the reservoir 820 is depleted, the one or more electrical properties of the pump 810 may change. The controller 800 may monitor the pump 810 for a change in electrical characteristics, and the controller 800 may generate an electrical signal that is indicative of whether the reservoir 820 is depleted. The controller 800 may generate an electrical signal that is indicative of whether the pump 810 is occluded. The controller 800 may generate an electrical signal that is indicative of whether gas has flowed through the pump 810 (e.g., when a measured electrical characteristic exceeds a characteristic threshold). As a result, a user may be notified that the reservoir 820 is depleted, or the flow through the pump 810 is occluded, and the user may add additional cleaning product to the reservoir 820 (or perform other maintenance tasks, such as cleaning the unit, or the like). Accordingly, the controller 800 may improve the performance of the dishwashing apparatus 100 because the controller 800 may ensure that the dishwashing apparatus 100 is operating with a sufficient amount of cleaning product, for instance to clean items in the wash chamber 110 (e.g., as shown in FIG. 1).

In some examples, the controller 800 may monitor cycles of the pump 810, for example when the pump 810 is modulated and liquid is pumped by the pump 810 The controller 800 may provide a notification, for instance when the controller 108 determines that a reservoir 820 is depleted based on the cycles of the pump 810, The controller 800 may provide a notification that the reservoir 820 is depleted based on the monitoring of cycles of the pump 810. In an example, the controller 800 modulates the pump 810 to pump a specified volume of cleaning product per cycle (e.g., per dishwashing cycle). The controller 800 monitors the pump 810 and the cycles of the pump 810. The controller 800 may determine the product level in the reservoir 820, for example based on the monitoring of the cycle of the pump 810. In some examples, the controller 800 provides a notification (e.g., instructions, an electrical signal, or the like) that the reservoir is depleted, for instance when the reservoir 800 has reached 20 percent of its overall capacity (however the present subject matter is not so limited). In some examples, the controller 800 may transmit a notification when the controller 800 determines the pump 810 is occluded, for instance to notify a technician that the apparatus 100 may need to be serviced.

As described herein, the controller 800 may determine whether the pump 810 is pumping a liquid, or a gas (or not pumping a liquid or a gas, for instance when the pump 810 is occluded). The controller 800 may modulate the pump 810 to prime the pump 810, for example using the determination of whether the pump 810 is pumping a liquid or a gas. In an example, the product reservoir 820 (or reservoirs 705, shown in FIG. 5) may be depleted (e.g., when the pump 810 withdraws all of the cleaning product from the reservoir 820). The depletion of the reservoir 820 may draw gas (e.g., air, or the like) into the pump 810, and accordingly the pump 810 may lose its prime. A first depleted, used, current, existing, or the like) reservoir 820 may be interchanged with a second reservoir 820 (e.g., new, or the like). The reservoir 820 may be manually refilled. The pump 810 may need to be primed, for example because the pump 810 lost its prime when the reservoir 820 was depleted. Accordingly, the controller 800 may modulate the pump 810 to purge gas from the pump 810 and withdraw liquid from the second (e.g., new, or the like) reservoir 820. Thus, the controller 800 may prime the pump 810, for example when the controller 800 determines the pump 810 is pumping (or has pumped) a gas (instead of a liquid).

Figure 9:
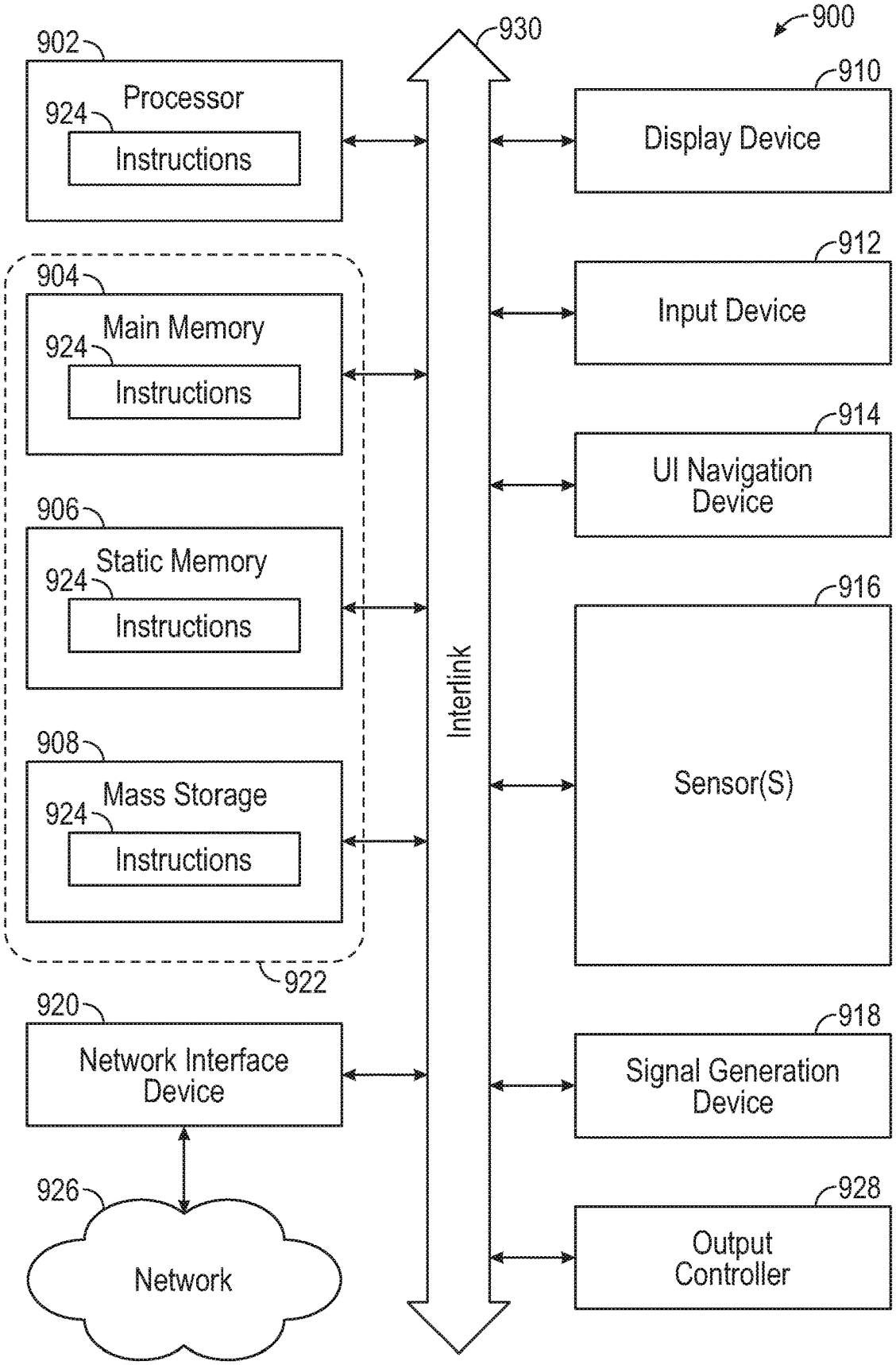
FIG. 9 illustrates a block diagram of an example machine according to one embodiment of the present subject matter.

FIG. 9 illustrates a block diagram of an example machine 900 upon which any one or more of the techniques (e.g., methodologies) discussed herein may perform, according to one embodiment of the present subject matter. The machine 900 may include the controller 800 (shown in FIG. 8). Examples, as described herein, may include, or may operate by, logic or a number of components, or mechanisms in the machine 900. Circuitry (e.g., processing circuitry), is a collection of circuits implemented in tangible entities of the machine 900 that include hardware simple circuits, gates, logic, etc.). Circuitry membership may be flexible over time. Circuitries include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a machine readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation. Accordingly, in an example, the machine readable medium elements are part of the circuitry or are communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time. Additional examples of these components with respect to the machine 900 follow.

In alternative embodiments, the machine 900 may operate as a standalone device or may be connected (e.g., networked) to other machines. In a networked deployment, the machine 900 may operate in the capacity of a server machine, a client machine, or both in server-client network environments. In an example, the machine 900 may act as a peer machine in peer-to-peer (P2P) (or other distributed) network environment. The machine 900 may be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

The machine (e.g., computer system) 900 may include a hardware processor 902 (e.g., a central processing unit (CPU), a graphics processing unit (GPU), a hardware processor core, or any combination thereof), a main memory 904, a static memory (e.g., memory or storage for firmware, microcode, a basic-input-output (BIOS), unified extensible firmware interface (UEFI), etc) 906, and mass storage 908 (e.g., hard drive, tape drive, flash storage, or other block devices) some or all of which may communicate with each other via an interlink (e.g., bus) 930. The machine 900 may further include a display unit 910, an alphanumeric input device 912 (e.g., a keyboard), and a user interface (UI) navigation device 914 (e.g., a mouse). In an example, the display unit 910, input device 912 and UI navigation device 914 may be a touch screen display. The machine 900 may additionally include a storage device (e.g., drive unit) 908, a signal generation device 918 (e.g., a speaker), a network interface device 920, and one or more sensors 916, such as a global positioning system (GPS) sensor, compass, accelerometer, or other sensor. The machine 900 may include an output controller 928, such as a serial (e.g., universal serial bus (USB), parallel, or other wired or wireless (e.g., infrared (IR), near field communication (NFC), etc) connection to communicate or control one or more peripheral devices (e.g., a printer, card reader, etc.).

Registers of the processor 902, the main memory 904, the static memory 906, or the mass storage 908 may be, or include, a machine readable medium 922 on which is stored one or more sets of data structures or instructions 924 (e.g., software) embodying or utilized by any one or more of the techniques or functions described herein. The instructions 924 may also reside, completely or at least partially, within any of registers of the processor 902, the main memory 904, the static memory 906, or the mass storage 908 during execution thereof by the machine 900. In an example, one or any combination of the hardware processor 902, the main memory 904, the static memory 906, or the mass storage 908 may constitute the machine readable media 922. While the machine readable medium 922 is illustrated as a single medium, the term "machine readable medium" may include a single medium or multiple media (e.g., a centralized or distributed database, and/or associated caches and servers) configured to store the one or more instructions 924.

The term "machine readable medium" may include any medium that is capable of storing, encoding, or carrying instructions for execution by the machine 900 and that cause the machine 900 to perform any one or more of the techniques of the present disclosure, or that is capable of storing, encoding or carrying data structures used by or associated with such instructions. Non-limiting machine readable medium examples may include solid-state memories, optical media, magnetic media, and signals (e.g., radio frequency signals, other photon based signals, sound signals, etc), In an example, a non-transitory machine readable medium comprises a machine readable medium with a plurality of particles having invariant (e.g., rest) mass, and thus are compositions of matter. Accordingly, non-transitory machine-readable media are machine readable media that do not include transitory propagating signals. Specific examples of non-transitory machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 924 may be further transmitted or received over a communications network 926 using a transmission medium via the network interface device 920 utilizing any one of a number of transfer protocols (e.g., frame relay, internee protocol (IP), transmission control protocol (TCP), user datagram protocol (UDP), hypertext transfer protocol (MTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, WEE 802.16 family of standards known as WiMax®), WEE 802.15.4 family of standards, peer-to-peer (P2P) networks, among others. In an example, the network interface device 920 may include one or more physical jacks (e.g., Ethernet, coaxial, or phone jacks) or one or more antennas to connect to the communications network 926. In an example, the network interface device 920 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 900, and includes digital or analog communications signals or other intangible medium to facilitate communication of such software. A transmission medium is a machine readable medium.

Figure 10:
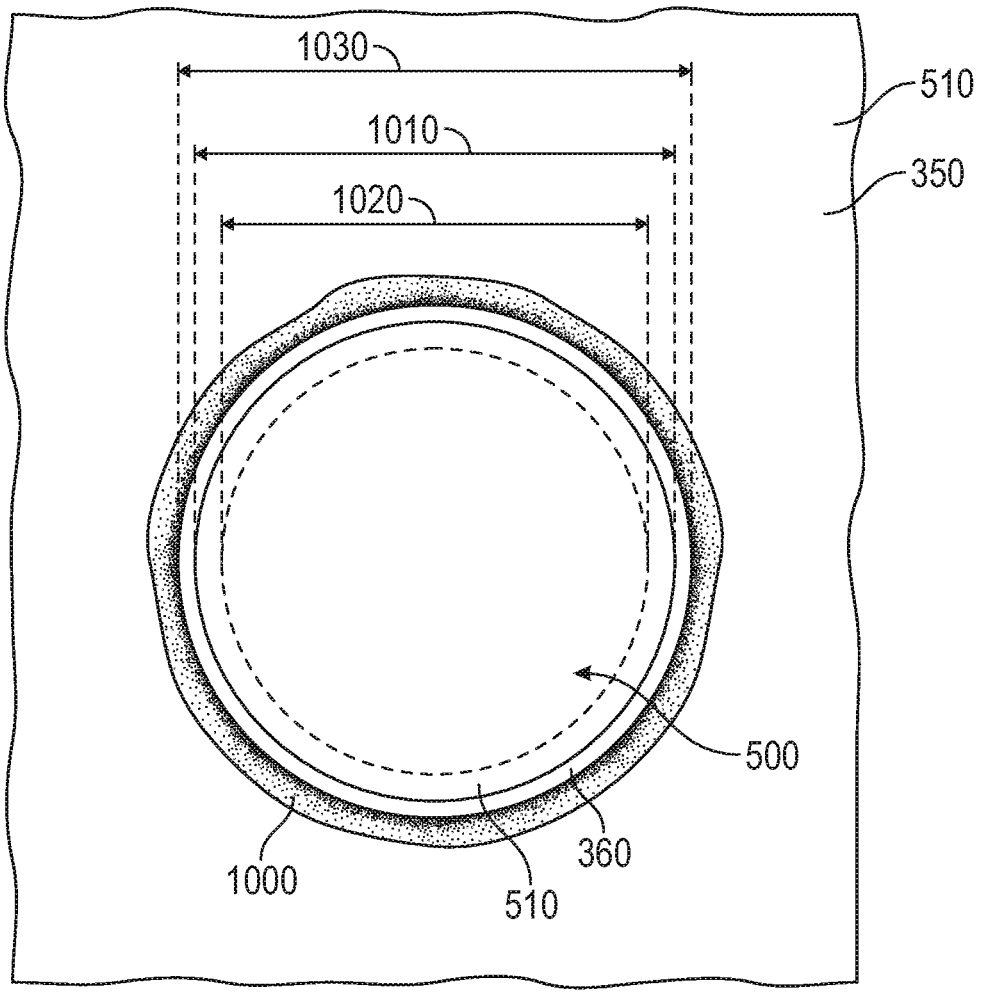
FIG. 10 illustrates a schematic view of an example of the sump of FIG. 3 according to one embodiment of the present subject matter.

FIG. 10 illustrates a schematic view of an example of the sump 200 of FIG. 3 according to one embodiment of the present subject matter. As described herein, a seal 1000 (e.g., a weld bead, junction, joint, seam, or the like) between the recirculation port 500 and the recirculation flange 360 (shown in FIG. 3) may be exposed to liquid. The exposure of the seal 1000 to liquid may be reduced, for instance by locating the recirculation port 500 in the first wall 510 of the sump well 350 (e.g., instead of the second wall 530 including the drain port 520. Reducing the exposure of a seal to liquid may reduce leakage past the seal, for instance dripping from the sump well 350 into the service compartment 220 (shown in FIG. 2).

In some examples, an inner diameter 1010 of the recirculation flange 360 may be greater than, or equal to, a diameter 1020 of the recirculation port 500. For example, the seal 1000 may be coupled with the first wall 510 and the recirculation flange 360. The seal 1000 may extend around an exterior of the recirculation flange 360, and the recirculation port 500 may be located in an interior of the recirculation flange 360. Accordingly, the seal 1000 between the recirculation flange 360 and the recirculation port 500 may be enhanced, for example because the seal 1000 is exposed to less liquid).

EXAMPLES

Example 1 is a sump for a dishwashing apparatus having a wash chamber, the sump connected to a recirculation pump, comprising: a sump pan including a pan inlet, the sump pan coupled with the wash chamber, and the pan inlet is arranged to receive liquid from the wash chamber; and a sump well coupled to the sump pan and configured to collect liquid from the sump pan, the sump well including: a well inlet in communication with the sump pan to receive liquid from the sump pan; a recirculation port extending through a first wall of the sump well, wherein the recirculation port is configured to provide liquid from the sump well to the recirculation pump; a drain port extending through a second wall of the sump well, wherein the second wall defines a bottom of the sump well; and wherein the sump pan and the sump well are formed from a unitary piece of material to avoid seams and joints between the sump pan and the sump well.

In Example 2, the subject matter of Example 1 optionally includes wherein the sump pan includes: a lip configured to be coupled with the wash chamber of the dishwashing apparatus; and a liquid containment portion that corresponds to a maximum level of liquid within the sump and that is below the lip.

In Example 3, the subject matter of Example 2 optionally includes inches away from the lip.

In Example 4, the subject matter of any one or more of Examples 1-3 optionally include a recirculation flange coupled to the first wall of the sump well, wherein the recirculation flange is in communication with the recirculation port, and the recirculation flange is configured to couple with a hose.

In Example 5, the subject matter of any one or more of Examples 1-4 optionally include wherein the recirculation flange extends at an angle from first wall.

In Example 6, the subject matter of any one or more of Examples 1-5 optionally include wherein the recirculation port is located proximate to the second wall.

In Example 7, the subject matter of any one or more of Examples 1-6 optionally include wherein the recirculation port is located remote from the drain port.

In Example 8, the subject matter of any one or more of Examples 1-7 optionally include at least one heating element through hole extending through the first wall, wherein the heating element through hole is configured to receive a portion of a heating element; and at least one thermostat through hole extending through the first wall, wherein the thermostat through hole is configured to receive a portion of a thermostat.

In Example 9, the subject matter of any one or more of Examples 1-8 optionally include inches away from a lip of the sump pan.

Example 10 is a dishwashing apparatus, comprising: a wash chamber; and a sump, including: a sump pan including a pan inlet, wherein the sump pan is configured to couple with the wash chamber, and the pan inlet is configured to receive liquid from the wash chamber; and a sump well coupled to the sump pan and configured to collect liquid from the sump pan, the sump well including: a well inlet in communication with the sump pan, wherein the sump pan is configured to convey liquid to the well inlet; a recirculation port extending through a first wall of the sump well, wherein the recirculation port is configured to provide liquid to a recirculation pump; a drain port extending through a second wall of the sump well, wherein the second wall defines a bottom of the sump well; and wherein the sump pan and the sump well are formed from a unitary piece of material.

In Example 11, the subject matter of Example 10 optionally includes wherein the sump is included in a bottom of the wash chamber.

In Example 12, the subject matter of any one or more of Examples 10-11 optionally include a base including a service compartment, wherein the wash chamber is coupled to the base, and the sump is at least partially located within the service compartment; and a component coupled to the base with a hinge, wherein the component is moveable to increase access to the service compartment.

In Example 13, the subject matter of any one or more of Examples 10-12 optionally include wherein the maximum level of liquid in the sump is below an interface where the wash chamber is coupled to the sump.

In Example 14, the subject matter of Example 13 optionally includes wherein the wash chamber is coupled with a lip of the sump, and the lip is located between the maximum level of liquid and the wash chamber.

In Example 15, the subject matter of any one or more of Examples 10-14 optionally include a diaphragm pump in communication with a wash chamber and configured to supply a cleaning product to the wash chamber during operation of the diaphragm pump; and a controller including a processor configured to: monitor one or more electrical characteristics of the diaphragm pump; determine a fluid flow metric indicative of whether fluid is flowing through the diaphragm pump during operation of the diaphragm pump based on the monitored electrical characteristics of the pump; and provide a notification if fluid is not flowing through the diaphragm pump during operation of the diaphragm pump based on the fluid flow metric.

Example 16 is a dishwashing apparatus, comprising: a cleaning product reservoir configured to store a cleaning product; a diaphragm pump in communication with the cleaning product reservoir and configured to supply the cleaning product to a wash chamber of the dishwashing apparatus during operation of the diaphragm pump; and a controller including a processor configured to: monitor one or more electrical characteristics of the diaphragm pump; and determine a fluid flow metric indicative of whether fluid is flowing through the diaphragm pump during operation of the diaphragm pump based on the monitored electrical characteristics of the pump.

In Example 17, the subject matter of Example 16 optionally includes wherein the controller including the processor is further configured to provide a notification if fluid is not flowing through the diaphragm pump during operation of the diaphragm pump based on the fluid flow metric.

In Example 18, the subject matter of any one or more of Examples 16-17 optionally include wherein the controller including the processor is further configured to: compare the monitored electrical characteristics of the diaphragm pump to a characteristic threshold; and provide the notification when the monitored electrical characteristics exceed the characteristic threshold.

In Example 19, the subject matter of any one or more of Examples 16-18 optionally include wherein the controller including the processor is further configured to: monitor current draw by the diaphragm pump; compare the current draw by the diaphragm pump to a current threshold; and provide an occlusion notification when the current draw by the diaphragm pump exceeds the current threshold, the occlusion notification indicative of whether the pump is occluded.

In Example 20, the subject matter of any one or more of Examples 16-19 optionally include wherein the controller including the processor is further configured to: monitor a voltage differential across the diaphragm pump; compare the voltage differential across the diaphragm pump to a voltage threshold; and provide a depleted notification when the voltage differential across the diaphragm pump exceeds the voltage threshold, the depleted notification indicative of whether the cleaning product reservoir is depleted.

In Example 21, the subject matter of any one or more of Examples 16-20 optionally include an electrical characteristic sensor configured to measure one or more electrical characteristics of the diaphragm pump; and wherein the electrical characteristics include one or more of: current draw by the diaphragm pump; or voltage differential across the diaphragm pump.

In Example 22, the subject matter of any one or more of Examples 16-21 optionally include wherein the controller including the processor is further configured to modulate the diaphragm pump to prime the diaphragm pump when the controller determines the diaphragm pump has pumped a gas.

This detailed description includes references to the accompanying drawings, which form a part of the detailed description. The drawings show, by way of illustration, specific embodiments in which the invention may be practiced. These embodiments are also referred to herein as "examples." Such examples may include elements in addition to those shown or described. However, the inventors also contemplate examples in which only those elements shown or described are provided.

Example 23 is a sump for a dishwashing apparatus having a wash chamber, the sump connected to a recirculation pump, comprising: a sump pan including a pan inlet, the sump pan coupled with the wash chamber, and the pan inlet is arranged to receive liquid from the wash chamber; and a sump well coupled to the sump pan and configured to collect liquid from the sump pan, the sump well including: a well inlet in communication with the sump pan to receive liquid from the sump pan; a recirculation port extending through a first wall of the sump well, wherein the recirculation port is configured to provide liquid from the sump well to the recirculation pump; a drain port extending through a second wall of the sump well, wherein the second wall defines a bottom of the sump well; and wherein the sump pan and the sump well are formed from a unitary piece of material to avoid seams and joints between the sump pan and the sump well.

In Example 24, the subject matter of Example 23 optionally includes wherein the sump pan includes: a lip configured to be coupled with the wash chamber of the dishwashing apparatus; and a liquid containment portion that corresponds to a maximum level of liquid within the sump and that is below the lip.

In Example 25, the subject matter of any one or more of Examples 23-24 optionally include a recirculation flange coupled to the first wall of the sump well, wherein the recirculation flange is in communication with the recirculation port, and the recirculation flange is configured to couple with a hose.

In Example 26, the subject matter of any one or more of Examples 23-25 optionally include wherein the recirculation port is located remote from the drain port.

Example 27 is a dishwashing apparatus, comprising: a wash chamber; and a sump, including: a sump pan including a pan inlet, wherein the sump pan is configured to couple with the wash chamber, and the pan inlet is configured to receive liquid from the wash chamber; and a sump well coupled to the sump pan and configured to collect liquid from the sump pan, the sump well including: a well inlet in communication with the sump pan, wherein the sump pan is configured to convey liquid to the well inlet; a recirculation port extending through a first wall of the sump well, wherein the recirculation port is configured to provide liquid to a recirculation pump; a drain port extending through a second wall of the sump well, wherein the second wall defines a bottom of the sump well; and wherein the sump pan and the sump well are formed from a unitary piece of material.

In Example 28, the subject matter of Example 27 optionally includes a base including a service compartment, wherein the wash chamber is coupled to the base, and the sump is at least partially located within the service compartment; and a component coupled to the base with a hinge, wherein the component is moveable to increase access to the service compartment.

In Example 29, the subject matter of any one or more of Examples 27-28 optionally include wherein the maximum level of liquid in the sump is below an interface where the wash chamber is coupled to the sump.

In Example 30, the subject matter of Example 29 optionally includes wherein the wash chamber is coupled with a lip of the sump, and the lip is located between the maximum level of liquid and the wash chamber.

In Example 31, the subject matter of any one or more of Examples 27-30 optionally include a diaphragm pump in communication with a wash chamber and configured to supply a cleaning product to the wash chamber during operation of the diaphragm pump; and a controller including a processor configured to: monitor one or more electrical characteristics of the diaphragm pump; determine a fluid flow metric indicative of whether fluid is flowing through the diaphragm pump during operation of the diaphragm pump based on the monitored electrical characteristics of the pump; and provide a notification if fluid is not flowing through the diaphragm pump during operation of the diaphragm pump based on the fluid flow metric.

Example 32 is a dishwashing apparatus, comprising: a cleaning product reservoir configured to store a cleaning product; a diaphragm pump in communication with the cleaning product reservoir and configured to supply the cleaning product to a wash chamber of the dishwashing apparatus during operation of the diaphragm pump; and a controller including a processor configured to: monitor one or more electrical characteristics of the diaphragm pump; and determine a fluid flow metric indicative of whether fluid is flowing through the diaphragm pump during operation of the diaphragm pump based on the monitored electrical characteristics of the pump.

In Example 33, the subject matter of Example 32 optionally includes wherein the controller including the processor is further configured to provide a notification if fluid is not flowing through the diaphragm pump during operation of the diaphragm pump based on the fluid flow metric.

In Example 34, the subject matter of any one or more of Examples 32-33 optionally include wherein the controller including the processor is further configured to: compare the monitored electrical characteristics of the diaphragm pump to a characteristic threshold; and provide the notification when the monitored electrical characteristics exceed the characteristic threshold.

In Example 35, the subject matter of any one or more of Examples 32-34 optionally include wherein the controller including the processor is further configured to: monitor current draw by the diaphragm pump; compare the current draw by the diaphragm pump to a current threshold; and provide an occlusion notification when the current draw by the diaphragm pump exceeds the current threshold, the occlusion notification indicative of whether the pump is occluded.

In Example 36, the subject matter of any one or more of Examples 32-35 optionally include wherein the controller including the processor is further configured to: monitor a voltage differential across the diaphragm pump; compare the voltage differential across the diaphragm pump to a voltage threshold; and provide a depleted notification when the voltage differential across the diaphragm pump exceeds the voltage threshold, the depleted notification indicative of whether the cleaning product reservoir is depleted.

In Example 37, the subject matter of any one or more of Examples 32-36 optionally include wherein the controller including the processor is further configured to modulate the diaphragm pump to prime the diaphragm pump when the controller determines the diaphragm pump has pumped a gas.

Example 38 may include or use, or may optionally be combined with any portion or combination of any portions of any one or more of Examples 1 through 37 to include or use, subject matter that may include means for performing any one or more of the functions of Examples 1 through 37, or a machine-readable medium including instructions that, when performed by a machine, cause the machine to perform any one or more of the functions of Examples 1 through 37.

In this document, the terms "a" or "an" are used, as is common in patent documents, to include one or more than one, independent of any other instances or usages of "at least one" or "one or more." in the following claims, the terms "first," "second," and "third," etc. are used merely as labels, and are not intended to impose numerical requirements on their objects.

The above description is intended to be illustrative, and not restrictive. For example, the above-described examples (or one or more Examples thereof) may be used in combination with each other. Other embodiments may be used, such as by one of ordinary skill in the art upon reviewing the above description.

What is claimed is:

1. An apparatus for supplying a cleaning product to a wash chamber, comprising:

a cleaning product reservoir configured to store the cleaning product;

a pump in communication with the cleaning product reservoir and configured to supply the cleaning product to the wash chamber during operation of the pump;

an electrical characteristic sensor in electrical communication with the pump, the electrical characteristic sensor configured to measure one or more electrical characteristics of the pump; and a controller communicatively coupled to the electrical characteristic sensor, the controller including a processor configured to determine whether fluid is flowing through the pump during operation of the pump based on the measured one or more electrical characteristics of the pump.

2. The apparatus of claim 1, wherein the controller including the processor is further configured to:

compare a first electrical characteristic of the measured one or more electrical characteristics of the pump to a characteristic threshold; and provide a notification when the first electrical characteristic exceeds the characteristic threshold.

3. The apparatus of claim 1, wherein the controller including the processor is further configured to:

measure a current draw by the pump;

compare the current draw by the pump to a current threshold; and provide an occlusion notification when the current draw by the pump exceeds the current threshold, the occlusion notification indicative of whether the pump is occluded.

4. The apparatus of claim 1, wherein the controller including the processor is further configured to:

measure a voltage differential across the pump;

compare the voltage differential across the pump to a voltage threshold; and provide a depleted notification when the voltage differential across the pump exceeds the voltage threshold, the depleted notification indicative of whether the cleaning product reservoir is depleted.

5. The apparatus of claim 1, wherein the pump comprises a diaphragm pump, and the controller including the processor is further configured to provide a notification if fluid is not flowing through the diaphragm pump during operation of the diaphragm pump based on the measured one or more electrical characteristics of the pump.

6. The apparatus of claim 5, wherein the controller including the processor is configured to determine whether the cleaning product reservoir is depleted and to provide the notification in response to a determination that the cleaning product reservoir is depleted.

7. The apparatus of claim 5, wherein the controller including the processor is configured to determine whether the pump is occluded and to provide the notification in response to a determination that the pump is occluded.

8. The apparatus of claim 1, wherein the pump comprises a diaphragm pump, the electrical characteristic sensor is configured to measure the one or more electrical characteristics of the diaphragm pump, and the one or more electrical characteristics include one or more of:

a current draw by the diaphragm pump; or a voltage differential across the diaphragm pump.

9. The apparatus of claim 1, wherein the pump comprises a diaphragm pump, and the controller including the processor is configured to determine whether the diaphragm pump is pumping a liquid or a gas.

10. The apparatus of claim 9, wherein the controller including the processor is further configured to modulate the diaphragm pump to prime the diaphragm pump when the controller determines the diaphragm pump has pumped a gas.

11. The apparatus of claim 1, further comprising a sump including:

a sump pan including a pan inlet, wherein the sump pan is configured to couple with the wash chamber, and the pan inlet is configured to receive liquid from the wash chamber; and a sump well coupled to the sump pan and configured to collect liquid from the sump pan, the sump well including:

a well inlet in communication with the sump pan, wherein the sump pan is configured to convey liquid to the well inlet;

a recirculation port extending through a first wall of the sump well, wherein the recirculation port is configured to provide liquid to a recirculation pump; and a drain port extending through a second wall of the sump well, wherein the second wall defines a bottom of the sump well, wherein the sump pan and the sump well are formed from a unitary piece of material.

12. A method for supplying a cleaning product to a wash chamber, comprising:

pumping the cleaning product from a cleaning product reservoir to the wash chamber using a pump;

measuring one or more electrical characteristics of the pump using an electrical characteristic sensor communicatively connected to the pump; and determining whether fluid is flowing through the pump during operation of the pump based on the measured one or more electrical characteristics.

13. The method of claim 12, comprising:

comparing a first electrical characteristic of the measured one or more electrical characteristics of the pump to a characteristic threshold; and providing a notification in response to the first electrical characteristic exceeding the characteristic threshold.

14. The method of claim 13, comprising:

measuring a current draw by the pump;

comparing the current draw by the pump to a current threshold; and providing an occlusion notification in response to the current draw by the pump exceeding the current threshold, the occlusion notification indicative of whether the pump is occluded.

15. The method of claim 13, comprising:

measuring a voltage differential across the pump;

comparing the voltage differential across the pump to a voltage threshold; and providing a depleted notification in response to the voltage differential across the pump exceeding the voltage threshold, the depleted notification indicative of whether the cleaning product reservoir is depleted.

16. The method of claim 12, wherein using a pump comprises using a diaphragm pump.

17. The method of claim 16, further comprising providing a notification in response to the measured one or more electrical characteristics indicating fluid is not flowing through the diaphragm pump during operation of the diaphragm pump.

18. The method of claim 16, wherein measuring the one or more electrical characteristics of the pump comprises measuring a voltage potential across a resistor in electrical communication with the diaphragm pump.

19. The method of claim 16, further comprising determining whether the diaphragm pump is pumping a liquid or a gas based on the measured one or more electrical characteristics.

20. The method of claim 19, further comprising modulating the diaphragm pump to prime the diaphragm pump in response to a determination that the diaphragm pump has pumped a gas.

* * * * *